United States Patent [19]

Santala et al.

[11] 4,115,325

[45] Sep. 19, 1978

[54] ELECTRICAL CONTACT MATERIAL

[75] Inventors: Teuvo J. Santala; Hans G. Hirsbrunner, both of Attleboro, Mass.

[73] Assignee: Texas Instruments Incorporated, Dallas, Tex.

[21] Appl. No.: 801,700

[22] Filed: May 31, 1977

[51] Int. Cl.[2] ..... H01B 1/02

[52] U.S. Cl. ..... 252/514; 75/234; 75/173 A; 200/265; 200/266

[58] Field of Search ..... 252/514; 75/234, 173 A; 200/265, 266

[56] References Cited

U.S. PATENT DOCUMENTS

| | | | |
|---|---|---|---|
| 2,200,854 | 5/1940 | Ruben | 75/173 A X |
| 3,880,777 | 4/1975 | Shibata | 252/514 |
| 3,954,459 | 5/1976 | Schreiner et al. | 252/514 X |

*Primary Examiner*—Benjamin R. Padgett
*Assistant Examiner*—E. Suzanne Parr
*Attorney, Agent, or Firm*—James P. McAndrews

[57] ABSTRACT

An electrical contact material comprises from about 85 to 87.5 percent silver and from about 0.01 to 0.10 percent cobalt in the form of an oxide, by weight. The material also comprises from about 10.73 to 12.82 percent cadmium oxide, from about 1.6 to 2.0 percent zinc oxide, and from about 0.15 to 1.0 percent lead oxide, by weight, internally oxidized in situ in the contact material in an oxygen enriched atmosphere.

5 Claims, 2 Drawing Figures

ELECTRICAL CONTACT MATERIAL

Figure 1:
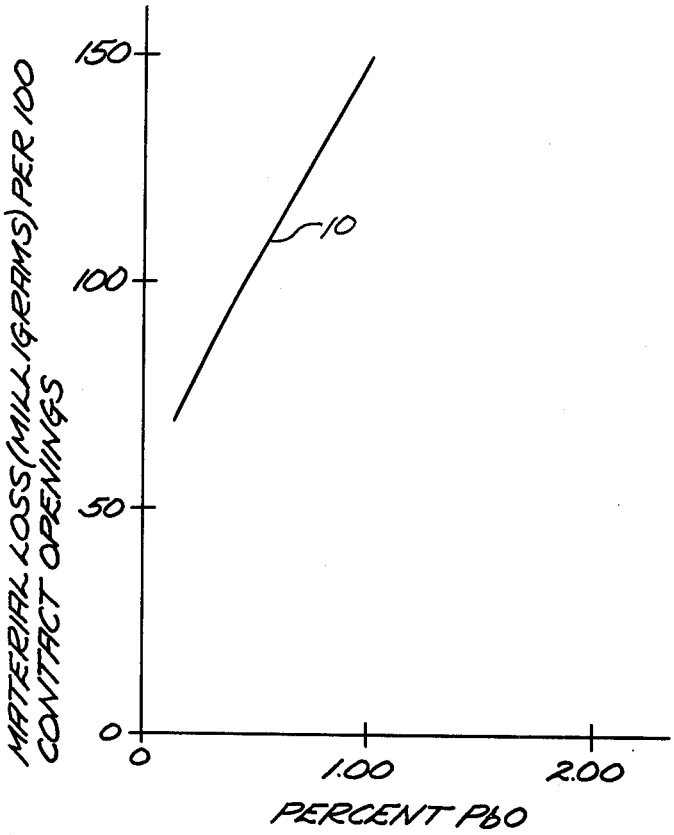

When electrical circuits carrying substantial loads are opened and closed by engagement and disengagement of electrical contacts, high temperatures and substantial electrical arcing occurs between the contacts. This tends to result in splattering of molten metal from the contact surfaces and to cause erosion or wearing away of the contact surfaces. On reengagement of the contacts after such arching there is also a tendency for surfaces of the mating contacts to weld together so that substantial forces may be required in reopening the contacts. When substantial erosion of the contact surfaces has occurred, the contacts usually have to be replaced and, where there is substantial welding, catastrophic failure can occur. For these reasons, where heavy duty or high reliability contacts have been required, it has been common practice for many years to use contacts having a metal oxide particulate dispersed in a metal matrix. Typically such contacts have incorporated cadmium oxide particles in a silver matrix although other metal oxides and matrix metals have also been used. In such contacts, the matrix metal has provided the desired high electrical conductivity and low contact surface resistance while the presence of the metal oxide constituent has significantly improved the arc erosion and weld resistance properties of the contacts. Such contacts have commonly been formed with conventional powder metallurgy techniques by pressing and sintering silver metal powder together with a cadmium oxide powder for example. On the other hand, where it has been desirable for process reasons to manufacture such electrical contacts by blanking or otherwise cutting selected contact shapes from a strip of more malleable contact material, or from a strip of multilayer material having a backing layer of oxide free metal, such contact strip material has frequently been made by internally oxidizing the cadmium content of a silver-cadmium alloy in situ in the contact material in an air or oxygen atmosphere, with or without the use of a grain refining agent in the material to assure that a dispersion of very fine cadmium oxide particles is formed in the silver matrix. However, particularly because of the high cost of replacement of such contacts, it would be desirable if even further improvement of the arc erosion properties of such internally oxidized contact materials and further reduction in the welding tendencies of such contacts could be effected while maintaining suitable malleability of the material for facilitating blanking of selected contact shapes from strips of the contact material.

It is an object of this invention to provide novel and improved electrical contact materials; to provide such improved materials having selected electrical conductivity and malleability which display improved arc erosion properties and service life; and to provide such improved materials which display improved weld resistance properties.

Briefly described, the novel and improved electrical contact materials of this invention are made by providing an alloy of silver, cobalt, cadmium, zinc and lead and by internally oxidizing the cadmium, zinc, cobalt and lead materials in situ in the alloy. The contact material comprises from about 85 to 87.5 percent silver, from about 0.01 to 0.10 percent cobalt oxide, from about 10.73 to 12.82 percent cadmium oxide, from about 1.6 to 2.0 percent zinc oxide, and from about 0.15 to 1.0 percent lead oxide, by weight. Preferably the zinc oxide content is kept about 2.0 percent or less by weight of the contact material. In this way the contact materials display remarkably improved arc erosion and weld resistance properties while also displaying suitable malleability and selected electrical conductivity at selected cost levels.

Figure 2:
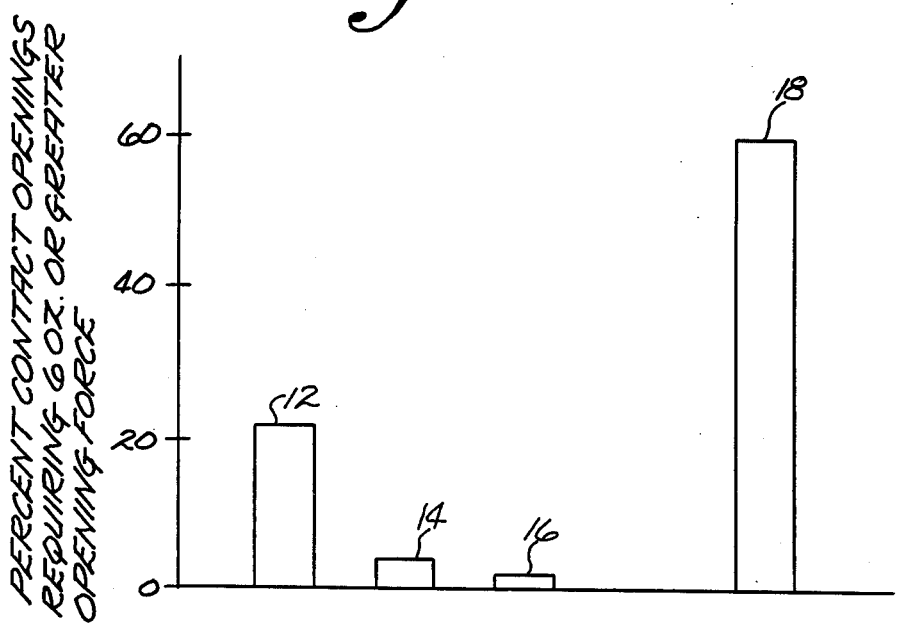

Other objects, advantages and details of the electrical contact materials of this invention appear in the following detailed description of preferred embodiments of the invention, the detailed description referring to the drawings in which:

FIGS. 1 and 2 are graphs illustrating the arc erosion and weld resistance properties of the contact materials of this invention.

In accordance with this invention, silver, cobalt, cadmium, zinc and lead metals are melted together in an induction furnace within a silicon carbide crucible or the like using borax or other similar material as a flux. The resulting alloy is then cast in a conventional manner and is preferably rolled to a thickness of from about 0.040 to 0.080 inches. Alternately a layer of the cast alloy is roll bonded to a backing layer of fine silver or the like to form a multilayer or composite metal material in a conventional manner and the composite material is rolled to a thickness from about 0.050 to 0.100 inches with the alloy layer having a thickness of from about 0.040 to 0.080 inches. The resulting strip material is then heated to a temperature in the range from about 800 to 850° C for about 20 to 40 hours in an oxygen enriched atmosphere for internally oxidizing the cadmium, zinc and lead constituents of the alloy in situ within the contact material or within the alloy or contact layer of the composite material. Preferably the noted atmosphere is maintained at about normal atmospheric pressure where the atmosphere comprises at least about 50 percent oxygen by weight and the remainder nitrogen but other oxygen enriched atmospheres at normal or greater than normal atmospheric pressures are also used. The constituents of the metal alloy are selected so that the resulting contact material, or contact layer of the composite material, comprises from about 85 to 87.5 percent silver, from 0.01 to 0.10 percent cobalt oxide, from about 10.73 to 12.82 percent cadmium oxide, from about 1.6 to 2.0 percent zinc oxide, and from about 0.15 to 1.0 percent lead oxide, by weight.

Electrical contacts are then blanked or otherwise cut from the contact material and, on testing, are found to display remarkably improved arc erosion properties while also display substantially improved weld resistance properties. Preferably the contact materials incorporate less than about 2.0 percent by weight zinc oxide, these contact materials being found to display a degree of malleability which is particularly suited for permitting blanking of contacts from strips of the contact material.

In a preferred embodiment of this invention for example, silver, cobalt, cadmium, zinc and lead are melted together in an induction furnace within a silicon carbide crucible using a borax flux in the following proportions:

| | |
|---|---|
| Silver | 3000 grams |
| Cobalt | 0.56 grams |
| Cadmium | 396.0 grams |
| Zinc | 56.7 grams |
| Lead | 5.2 grams |

The resulting alloy is then cast into an ingot and is preferably roll bonded to a fine silver backing layer to form a multilayer or composite material having a total thickness of about 0.75 inches and having a layer of the noted alloy of about 0.060 inches thickness. The resulting composite material is then heated to a temperature of about 850° C for about 24 hours in one atmosphere of oxygen for internally oxidizing the cobalt, cadmium, zinc and lead constituents of the noted alloys in situ within the contact material. This contact material has a composition of 85 percent silver, about 0.02 percent cobalt oxide, 12.82 percent cadmium oxide, 2.00 percent zinc oxide, and 0.16 percent lead oxide by weight. In this contact material, the cobalt additive provides nucleation centers for oxide precipitation to enhance formation of sperical oxide particles and to retard oxide precipitation at grain boundaries within the contact material. The oxide particles are found to be substantially spherical and to be primarily in the size range from 0.25 to 2.5 microns. Further, although some platelets of oxide are present, spherical oxide particles are distributed with substantial homegeneity throughout the contact layer of the material and the contact layer is found to be substantially free of grain boundary oxide precipitation. With this composition the contact material displayed a desired electrical conductivity and acceptable malleability.

Electrical contacts were then blanked from the contact material in a conventional manner, the contacts being formed with a diameter of about 0.437 inches, with a thickness of about 0.073 inches, and with a crown on the alloy side of the contacts of about 1.25 inches radius. After weighing, the contacts were mounted in mating pairs in an electrical circuit having a half-wave applied open circuit voltage of about 10 volts a.c. and at 5000 amperes and the circuit was repeatedly opened by disengaging the contacts from each other to test the arc erosion properties of the materials with only a single polarity relationship between the contacts. Substantial arcing occurred during the contact separation and, after opening, the circuit was interrupted by other means while the contacts were engaged. The contacts were opened at a speed of about 100 centimeters per second with a force of 1 kilogram and were reengaged with a force of 2 kilograms. The contacts were reweighed after each 100 openings as described and the weight loss of the contacts was determined. As shown by curve 10 in FIG. 1, the weight loss of these contacts was about 61 grams for each 100 openings of the noted circuit.

Other contacts produced in the same manner were then mounted in mating pairs in an electrical circuit having an applied open circuit voltage of about 108 volts d.c. and at 240 amperes to test the weld resistance properties of the contact materials. The contacts were briefly separated to a spacing of 0.0125 inches and were then reengaged so that arching occurred between the contacts for 6 milliseconds. The contacts were closed with a contact engagement force of 32 ounces. After closing, the contacts were separated while the force required for separation was measured. As indicated by bar 12 in FIG. 2 only about 22 of each 100 contact openings required a contact separation force of 6 ounces or more.

The contact materials were also found to have suitable malleability. Thus, for the degree of electrical conductivity provided by the contact material, the material displayed remarkably improved arc erosion and weld resistance properties while displaying acceptable malleability characteristics.

In another preferred embodiment of the invention, contacts were prepared and tested in a similar manner, the contact layer of the material comprising 85 weight percent silver, about 0.02 weight percent cobalt oxide, 12.62 weight cadmium oxide, 2.0 weight percent zinc oxide, and 0.36 weight percent lead oxide.

As shown in curve 10 in FIG. 1, the contact material showed an arc erosion loss of only 89 milligrams per 100 contact openings. During the test for welding properties, only 5 of the contact openings required a contact separation force of 6 ounces as indicated by bar 14 in FIG. 2. The contacts were found to have suitable malleability.

In another preferred embodiment of the invention, contacts were prepared and tested in a similar manner, the contact layer of the material comprising 85 weight percent silver, about 0.02 weight percent cobalt oxide, 11.98 weight percent cadmium oxide, 2.0 weight percent zinc oxide, and 1.0 weight percent lead oxide. As shown in curve 10 in FIG. 1, the contact material showed an arc erosion loss of only 155 milligrams per 100 contact openings. During the test for welding properties, only 3 of the contact openings required a contact separation force of 6 ounces or more as indicated by bar 16 in FIG. 2. The contacts were found to have suitable malleability.

In another preferred embodiment of the invention, contacts were prepared and tested in a similar manner, the contact layer of the material comprising 87.5 weight percent silver, about 0.02 weight percent cobalt oxide, 10.73 weight percent cadmium oxide, 1.6 weight percent zinc oxide, and 0.15 weight percent lead oxide. The contact material showed an arc erosion loss of about 65 milligrams per 100 contact openings. During the test for welding properties, only 7 of the contact openings required a contact separation force of 6 ounces or more. The contacts were found to have suitable malleability.

For comparison purposes, contacts were also prepared and tested in a similar manner with a contact material layer comprising 85 weight percent silver, about 0.02 weight percent cobalt and 14.98 weight percent cadmium oxide. This contact material displayed an arc erosion loss of 360 milligrams per 100 contact openings. During the test for welding properties, 48 of the contact openings required a contact separation force of 6 ounces or more.

For comparison purposes, contacts were also prepared and tested in a similar manner with a contact material layer comprising 85 weight percent silver, about 0.02 weight percent cobalt, 12.98 weight percent cadmium oxide, and 2.0 weight percent zinc oxide omitting any lead oxide. This contact material displayed an arc erosion loss of 72 milligrams per 100 contact openings but during the test for welding properties, 62 of the contact openings required a contact separation force of 6 ounces or more as indicated by bar 18 in FIG. 2.

It can therefore be seen that the contact materials of this invention displayed very substantially improved arc erosion properties while also displaying substantially improved weld resistance characteristics. In other trials, where the various constituents of the contact materials were internally oxidized in air without oxygen enrichment as noted above, the malleability of the contact materials was found to be unsatisfactory.

With regard to the cobalt content of the contact materials of this invention, it is found that the noted beneficial effect of the cobalt additive in providing nucleation centers for formation of fine particles of oxide in the contact is achieved where as little as about 0.01 weight percent of cobalt is used and that additions of cobalt above about 0.10 weight percent add little additional beneficial effect. However, while additions from about 0.15 to 0.25 weight percent of cobalt do not detract from the beneficial effects achieved, it is difficult as a practical matter to retain more than about 0.10 weight percent cobalt in the alloy.

It can therefore be seen that, from the electrical conductivity and manufacturing costs achieved, electrical contact materials as provided by this invention display remarkably improved arc erosion and resistance to contact welding while maintaining suitable malleability for facilitating blanking of contacts from strips of the contact materials.

It should be understood that although preferred embodiments of this invention are described by way of illustrating this invention, this invention includes all modifications and equivalents of the disclosed embodiments falling within the scope of the appended claims.

We claim:

1. An electrical contact material comprising from 85 to 87.5 percent silver, by weight and from 0.01 to 0.10 percent cobalt oxide, by weight, and from 10.73 to 12.82 percent cadmium oxide, from 1.6 to 2.0 percent zinc oxide and from 0.15 to 1.0 percent lead oxide by weight, internally oxidized in situ in the contact material in an oxygen enriched atmosphere.

2. An electrical contact material as set forth in claim 1 comprising about 85 percent silver, by weight, and from 11.98 to 12.82 percent cadmium oxide, 0.02 percent cobalt oxide, 2.00 percent zinc oxide, and from 0.16 to 1.0 percent lead oxide, by weight, internally oxidized in situ in the contact material in an oxygen atmosphere.

3. An electrical contact material comprising a layer of electrical contact mterial as set forth in claim 2 metallurgically bonded to a layer of fine silver.

4. An electrical contact material as set forth in claim 1 comprising about 87.5 percent silver, by weight, and 0.02 percent cobalt oxide, about 10.73 percent cadmium oxide, 1.6 percent zinc oxide, and 0.15 percent lead oxide, by weight, internally oxidized in situ in the contact material in an oxygen atmosphere.

5. An electrical contact material comprising a layer of electrical contact material as set forth in claim 4 metallurgically bonded to a layer of fine silver.

* * * * *